US006109458A

United States Patent [19]

Walsh et al.

[11] Patent Number: 6,109,458

[45] Date of Patent: Aug. 29, 2000

[54] PRODUCT ADVANCEMENT ROLL

[75] Inventors: Robert M. Walsh, Flower Mound; Leo C. Squiers, Grapevine, both of Tex.

[73] Assignee: Frontline, Inc., Grapevine, Tex.

[21] Appl. No.: 09/321,777

[22] Filed: May 27, 1999

[51] Int. Cl.[7] ..... A47F 1/04

[52] U.S. Cl. ..... 211/59.3; 312/71

[58] Field of Search ..... 211/59.3, 43, 51; 312/71

[56] References Cited

U.S. PATENT DOCUMENTS

| | | | |
|---|---|---|---|
| 2,076,941 | 4/1937 | Farr | 211/43 |
| 3,166,195 | 1/1965 | Taber | 211/59.3 X |
| 3,182,806 | 5/1965 | Lambert | 211/43 |
| 3,426,115 | 2/1969 | Taber | 264/160 |
| 3,712,463 | 1/1973 | Bestehorn | 211/49.1 X |
| 3,848,745 | 11/1974 | Smith | 211/59.3 |
| 5,161,702 | 11/1992 | Skalski | 211/59.3 |
| 5,634,564 | 6/1997 | Spamer et al. | 211/59.3 |

*Primary Examiner*—Daniel P. Stodola
*Assistant Examiner*—Erica B. Harris
*Attorney, Agent, or Firm*—John E. Vandigriff

[57] ABSTRACT

A product advancement device utilizes a self-coiling plastic sheet of material that has been heat treated to provide the self-coiling properties. The self-coiling sheet is used on an existing shelf to advance products to the front of the shelf without the use of push plates, trays, or other parts to hold the coiled sheet in place, or to prevent it from unrolling laterally or vertically. A portion of the sheet is not coiled during the heating process so that the roll stops at a desired place, providing a product restocking area. The end of the non-coiling sheet, opposite the coiled portion, is formed to provide a product stop barrier at the edge of the shelf.

15 Claims, 7 Drawing Sheets

PRODUCT ADVANCEMENT ROLL

FIELD OF THE INVENTION

The invention relates to product storage and display devices, and more particularly to an apparatus designed to maintain product displays on an existing product shelf and advance the product to the front of the shelf as products are removed.

BACKGROUND OF THE INVENTION

A product advancement roll can be used on existing shelves to maintain the placement of products placed one behind the other in front of the placement roll. The roll is unfurled backward from the edge of the shelf and products are placed on the unfurled portion of the roll. The roll curls back upon itself as products are removed from the front of the shelf, advancing the remainig products toward the front of the shelf.

In prior art devices, the advancement device is spring and backing plate device, the movement of which is contained by complex tracks and locking mechanisms that have to be incorporated into the advancement mechanism contained in molded trays or displays which are costly and inefficient.

U.S. Pat. No. 5,161,702 illustrates a device with channels that have vertically coiled springs, incorporated within molded trays, that act in concert to move a product forward. This device is complex and expensive.

U.S. Pat. No. 5,069,349 shows a product advancement device that uses a coiled spring. The spring has to be supported laterally to hold the spring in position and to keep it from unwinding sideways or vertically. A plate, connected to the spring within molded trays, is used to push the product forward.

Several other patents, U.S. Pat. Nos. 5,634,564, 5,562,217 and 4,899,893 use similar principles in which a plate and spring are used to advance the product. Each of the mechanism are incorporated into a molded tray or display.

Self-Coiling sheets are described in U.S. Pat. No. 3,426,115. Described is the method of making a sheet of a plastic material self-coiling by heating below the melting point. A similar process is utilized in the present invention, described below.

BRIEF SUMMARY OF THE INVENTION

The invention is a product advancement device that utilizes a self-coiling plastic sheet of material that has been heat treated to provide the self-coiling properties. The self-coiling sheet is used on an existing shelf to advance products to the front of the shelf without the use of push plates contained in trays with built in track and other parts to hold the coiled spring in place, or to prevent it from unrolling laterally or vertically. A portion of the sheet is not coiled during the heating process so that the coil stops at a desired place, allowing space for easy product restocking. In another embodiment, the end of the non-coiling sheet opposite the coiled portion is formed to provide a product stop barrier formed to any desired height or configuration at the edge of a shelf where none preexists.

DESCRIPTION OF A PREFERRED EMBODIMENT

Figure 1:
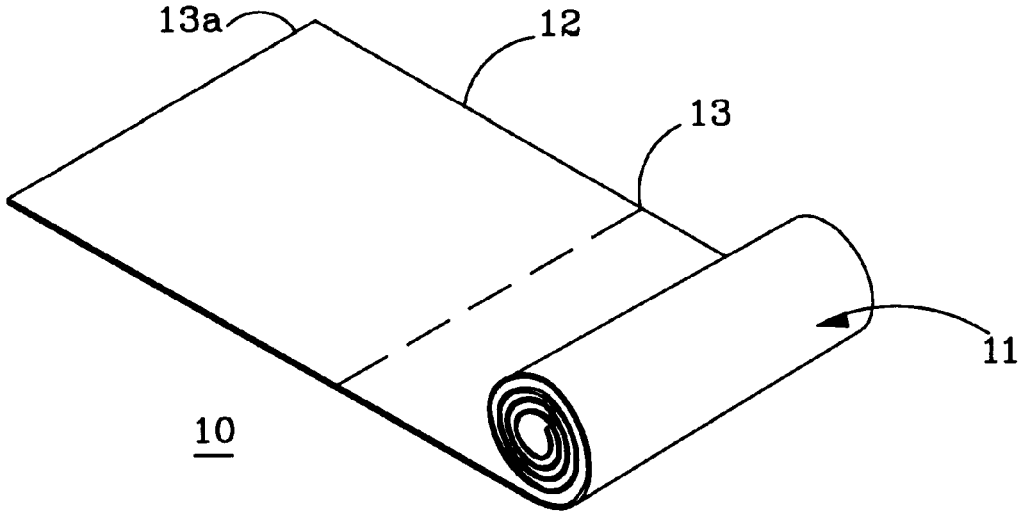
FIG. 1 shows an advancement roll with a flat portion.

The invention is a product advance device that is placed on an existing product shelf. A roll of material, for example, a plastic material, is placed on the shelf and unrolled. Products are placed upon the rolled out material. As products are removed from the front of the shelf, the remaining products are pushed forward toward the front edge of the self. FIG. 1 shows a product advance device 10 which is a coiled material 11, for example plastic or other coilable material that can hold a rolled configuration, with a flat non-coiling section 12. The product advance device is made, as described below, by applying heat to the plastic while roll 11 is coiled and section 12 is flat. The plastic material was held flat between dashed line 13 and end 13*a* while heat was applied. The flat area provides an area for attachment to a shelf, area to form an optional product stop, and allows space for ease of product restocking.

Figure 2:
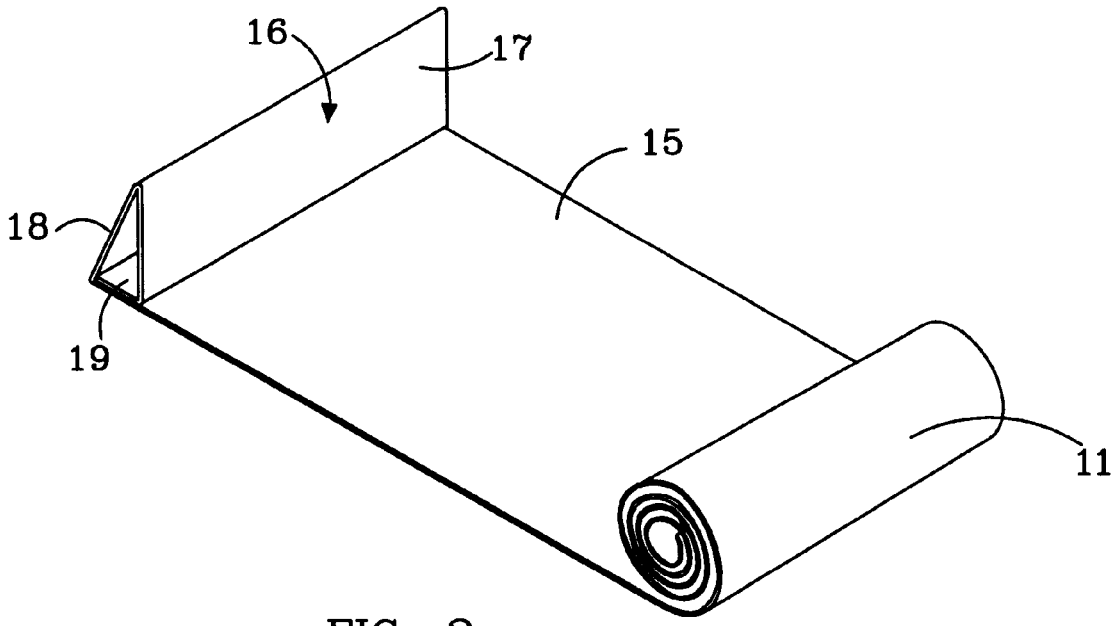
FIG. 2 shows an advancement roll with a product stop end.

FIG. 2 shows the coil 11 having a flat section 15, and a stop or barrier end 16. End 16 prevents coil from moving a product over the edge of a shelf. The section 15 may be a rolling section or a non-rolling section as described about with reference to FIG. 1. End 16 is formed from the plastic material by heating and bending section 18 upward at an angle, bending section 17 vertically downward, and then bending section 9 parallel to the end of section 15. After heating, end 16 is rigid and will not lose its shape. A triangle is shown, but stop 16 may be of any shape that creates a product stop end.

Figure 3:
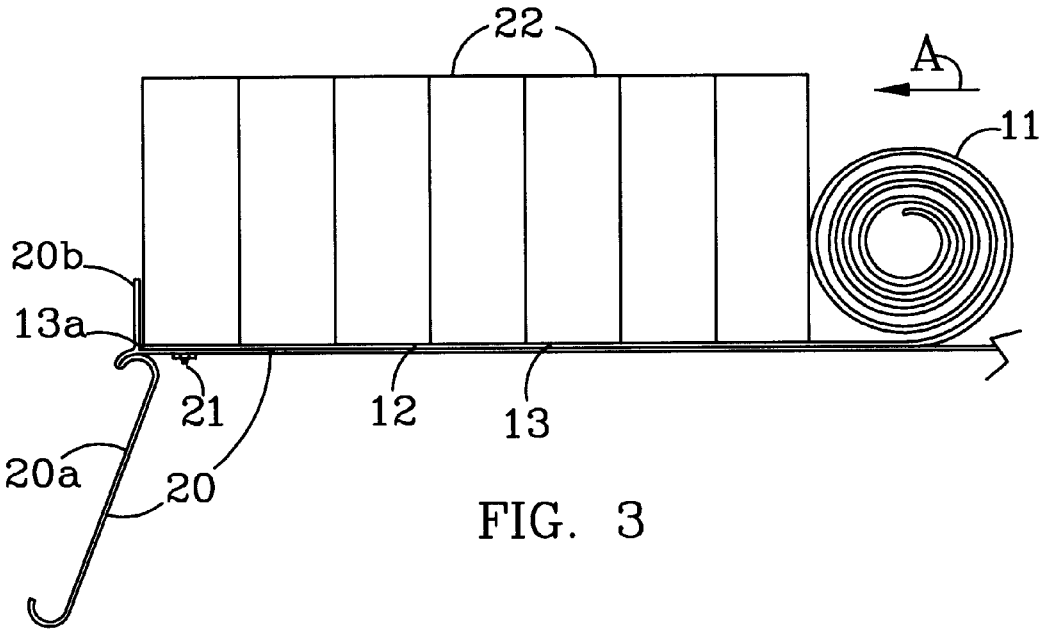
FIG. 3 shows the advancement roll with products on a product shelf.

FIG. 3 illustrates mounting the product advance device on a shelf 20. Roll-up coil 11 is partially un-coiled with a plurality of products 22 on the rolled-out flat portion 12. End 13*a* is secured to shelf 20 by a fastener 21. Fastener 21 may be a screw, rivet, glue strip, lock tie, or any other device that can secure the end 13*a* to a shelf. As a product 22 is removed, advancement roll 11 will coil-up in the direction indicated by arrow A moving the products 22 toward the front 20*b* of shelf 20 on which the advancement product is mounted. Advancement roll 11 will not coil past 13 so that the last product will not be pushed past the end of the material 13*a*.

Figure 4:
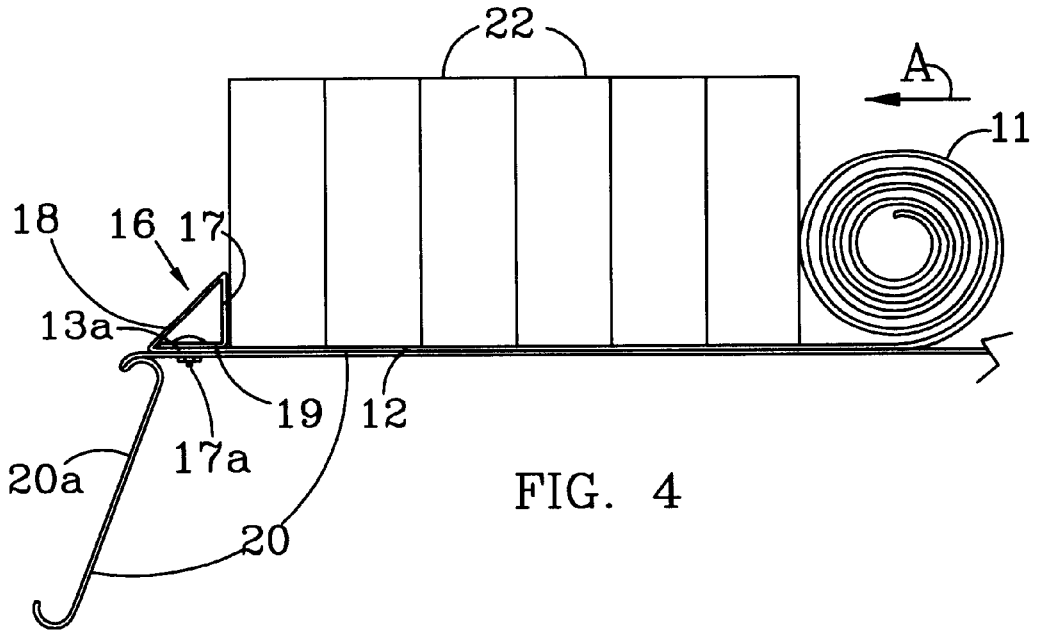
FIG. 4 shows the advancement roll with product stop end on a product shelf.

FIG. 4 is similar to FIG. 3 with the addition of the stop end 16 which is secured to shelf 20 by fastener 17*a*. When a product 22 is removed from the shelf 20, advancement roll will push the remaining products toward stop surface 17. With the stop end 16, a flat non-coiling area provides a free area for product restocking.

Figure 5:
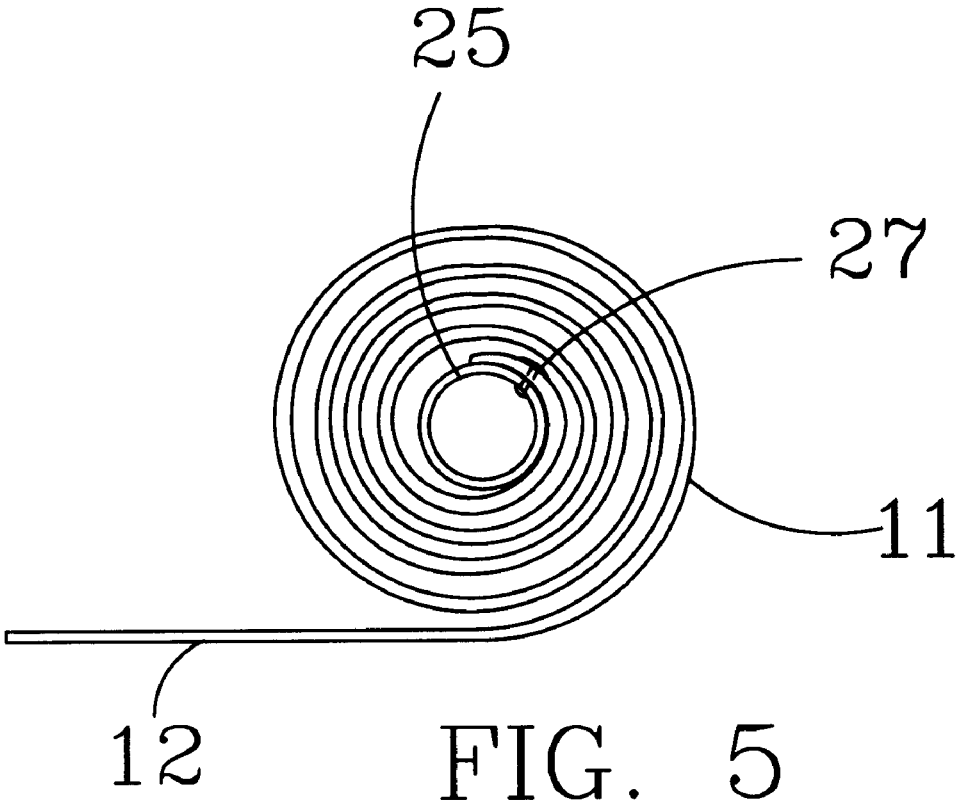
FIG. 5 shows a self-coil with a cylindrical support.
Figure 6:
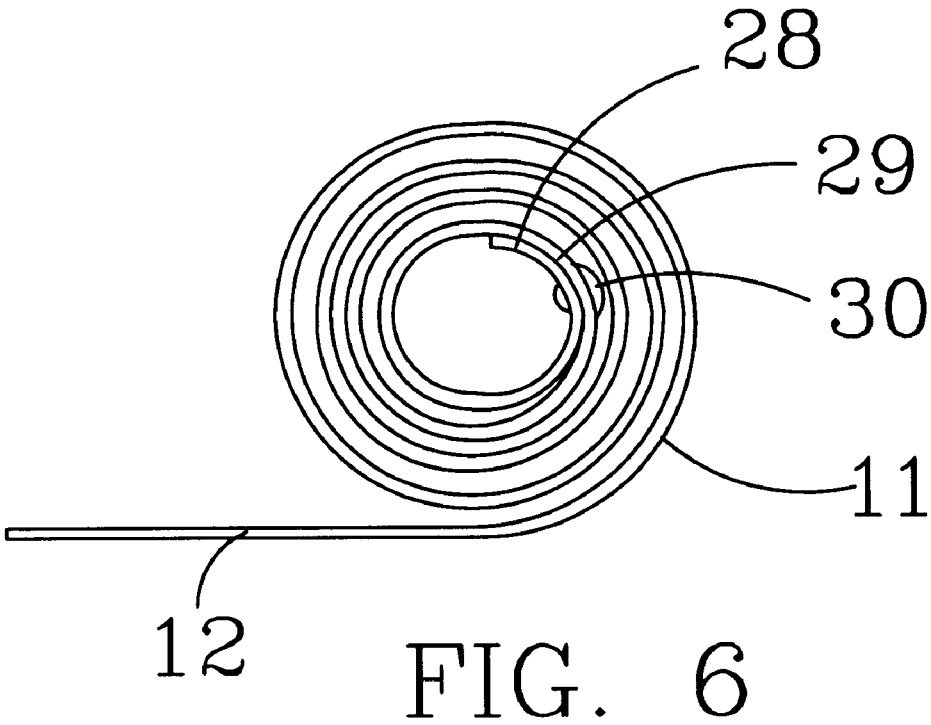
FIG. 6 shows a self-support for self-coil roll.

To provide strength and prevent complete uncoiling to advancement roll 11, advancement roll 11 may be coiled around and attached to a cylindrical tube 25. Advancement roll 11 is shown attached to cylinder 25 by several screws or rivets 27. This is illustrated in FIG. 5. Alternately, the several layers or coils of advancement roll 11 may attached together by screws or rivets 30. In FIG. 6, the first two inner coils 28 and 29 are attached together by screws or rivets 30.

Figure 7:
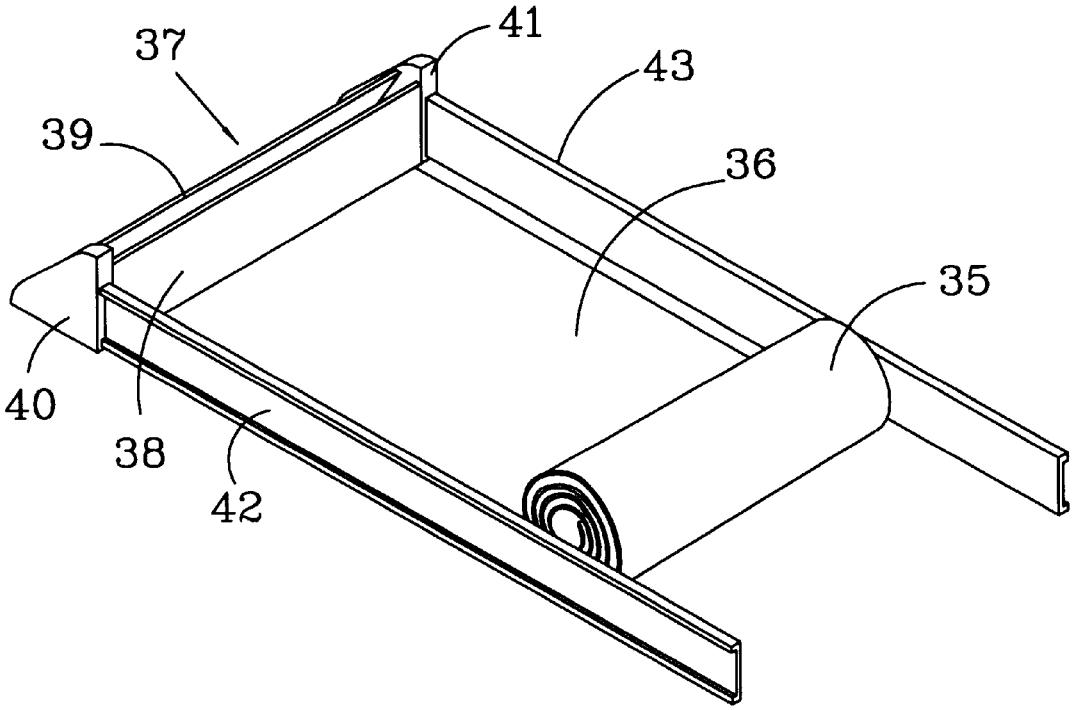
FIG. 7 shows product advance device with optional product guides.

When square or flat sided products are on the shelf, advancement roll 11 will push them forward in a straight line, but if the products are bottles or in generally round containers, then they tend to roll off from each other and do not move in a straight line as advancement roll 11 moves them forward. In this case, guides are used. FIG. 7 shows a coil 35 that moves products on surface 36 between product guides 42 and 43. The optional rails are attached to stop 37 which has a vertical back 38 and a sloped front panel 39 secured to rails 42 and 43 by ends 40 and 41.

Figure 8:
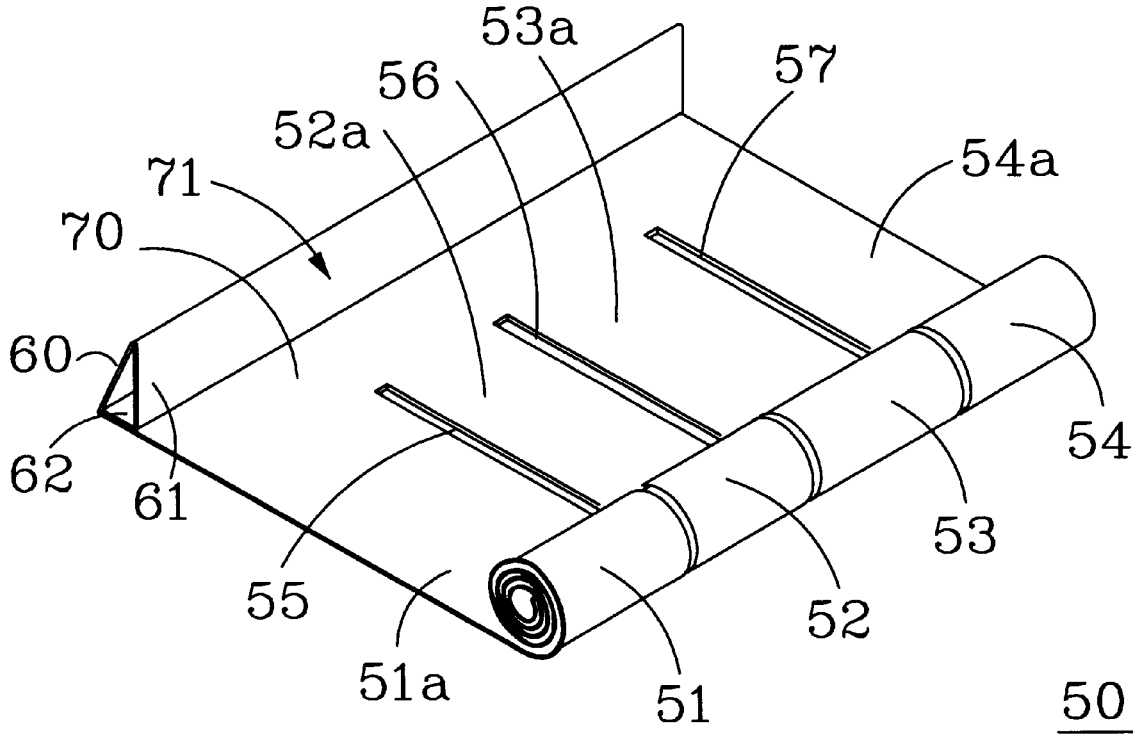
FIG. 8 shows joined multiple self-coil advance rolls.

The above described product advance devices have been for a single row of products. FIG. 8 illustrates a multi-product advance device. Self-coiling roll 50 is cut into two or more rolls by cutting the roll 50 and a part of the flat area made up of segments 51*a*–54*a*. Segments 51*a*–54*a* are separated by cuts or slots 55, 56 and 57 which are made when roll 50 is cut into independent rolls. Segments 51*a*–54*a* are joined at a common area 70 which extends to product stop 71 includes parts 60, 61 and 62, or an existing shelf stop. Product stop 71 is formed in the same manner as product stop 16 in FIG. 2. Each of the rolls 51–54 roll up independent of each other, allowing different or similar products to be dispensed independent of adjacent products.

Figure 9:
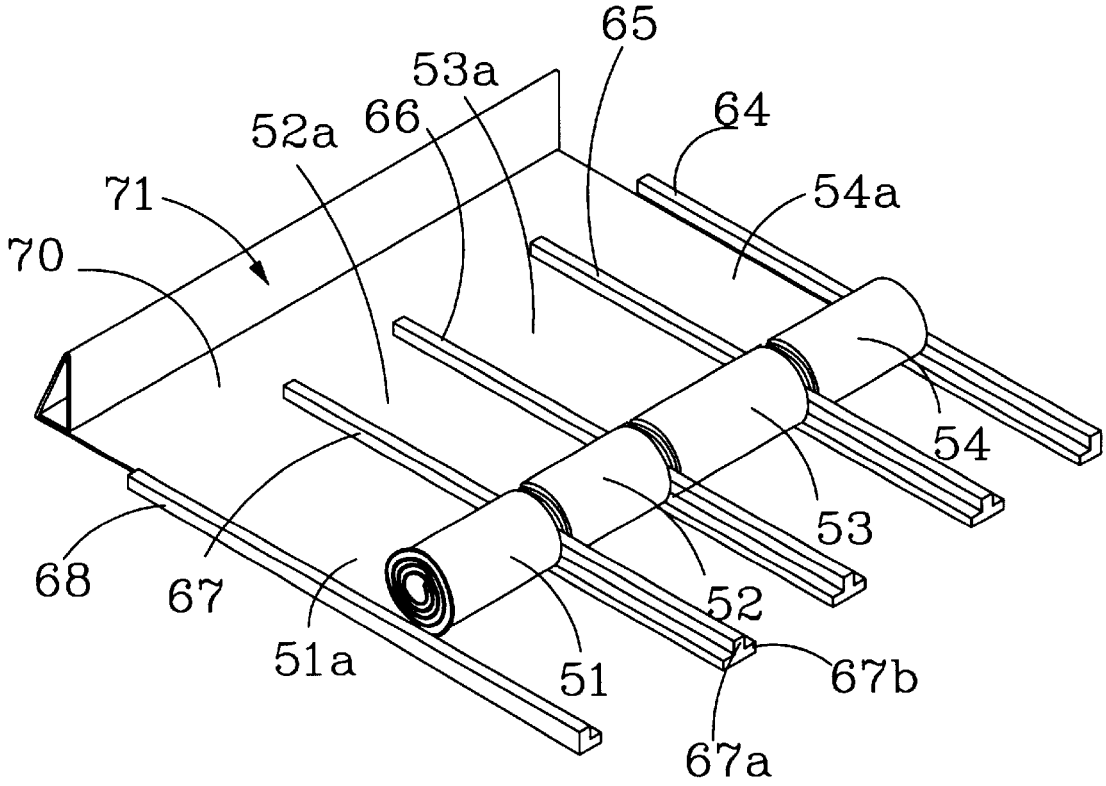
FIG. 9 shows the joined multiple self-coiled advance roll with product guides.

FIG. 9 shows the product advance device of FIG. 8 with optional product guides mounted in the slots 55–57. The outer two rails 64 and 68 are L shaped, while the guides, 65,66 and 67, in the slots 55–57 are inverted T rails, with the a base (on guide 67) 67*b* on the shelf (not illustrated) and part 67*a* extending up into the slots 55–57 (FIG. 8). Rails 64–68 help keep the different products separated, or guide rounded products forward.

Figure 10:
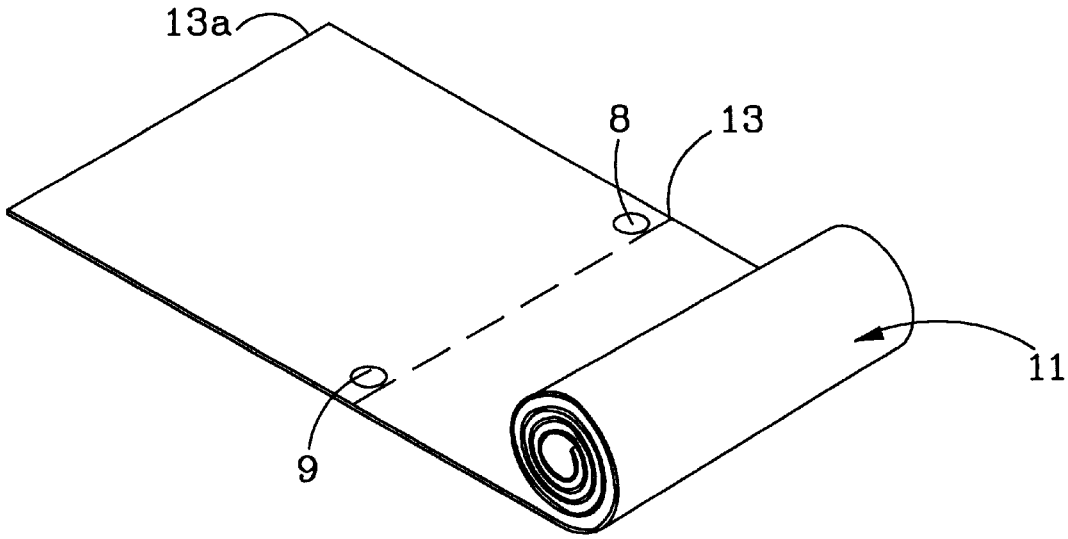
FIG. 10 shows a variation on the self-coiling advance roll of FIG. 1.

In the embodiments described above, a flat area (12, FIG. 1) formed during the self-coiling roll process has been described along with the forming of a product stop end (16, FIG. 2). FIG. 10 shows an embodiment that can be used with a self-coiling product advance device that has or does not have a formed flat area. The advancement roll can be attached to a shelf with screws 8 and 9, and the advancement roll will not coil past rivets 8 and 9.

A self-coiling sheet is shown in U.S. Pat. No. 3,426,115, and the basic process for making it is described. In the present invention, the process is expanded by coiling only a portion of the flat sheet and leaving a portion of the sheet flat. The partially coiled sheet is heated as described in U.S. Pat. No. 3,426,115 with a partial coil and a flat area. This provides the product advance device illustrated in FIG. 1. The process can be taken a step further by forming the product stop end (16, FIG. 2) prior to the heat treatment of the plastic sheet. In the heating process, the coiled sheet, flat area, and folded product stop end are heated to a temperature below the melting point of the material to permanently form the self-coiling roll, the flat area and product stop. It has been found that the elasticity or coiling strength can be varied by controlling the temperature at which the material is heated. The higher the temperature, the greater the coiling strength. Coiling strength may also be varied by using different thickness of the material to be used.

What is claimed is:

1. A product advance device, comprising:

a heat treated sheet of plastic material;

a self-coiling roll formed from a portion of the plastic material for engaging and moving a product;

a flat non-coiling area of the plastic material extending from the self-coiling roll;

a product stop formed at the free end of said flat non-coiling area from the same material as the self-coiling roll.

2. The product advance device according to claim 1, including a reenforcing cylinder inside of and attached to said self-coiling roll.

3. The product advance device according to claim 1, wherein at least two coils of said self-coiling roll are attached to each other to strengthen the roll.

4. The product advance device according to claim 1, including product guides between which the self-coiling roll moves.

5. The product advance device according to claim 1, including at least one fastening device holding the self-coiling roll to a surface to prevent the roll from completely coiling into a roll.

6. The product advance device according to claim 1, wherein a portion of the self-coiling roll is cut into a plurality of rolls, each of the plurality of rolls joined to the flat non-coiling area extending from the self-coiling roll.

7. The product advance device according to claim 6, including openings between the plurality of rolls where they were separated by cutting, and product guides extending upward in the openings.

8. A product advance device, comprising, a self-coiling roll portion;

a flat non-coiling area portion extending from the self-coiling roll; and a product stop portion formed at a free end of said flat non-coiling area from the same piece of material as the self-coiling roll.

9. The product advance device according to claim 8 including a reenforcing cylinder inside of and attached to said self-coiling roll.

10. The product advance device according to claim 8, wherein at least two coils of said self-coiling roll are attached to each other to strengthen the roll.

11. The product advance device according to claim 8, including product guides, to guide rounded and odd shape products, between which the self-coiling roll moves.

12. The product advance device according to claim 8, including at least one fastening device holding the self-coiling roll to a surface to prevent one end of the roll from completely coiling into a roll.

13. The product advance device according to claim 8, wherein said self-coiling roll is cut into a plurality of rolls, each of the plurality of rolls joined to the flat non-coiling area extending from the self-coiling roll.

14. The product advance device according to claim 13, including openings between the plurality of rolls where they were separated by cutting, and rails extending upward in the openings.

15. A method of forming a product advance device, comprising the steps of:

forming a coil from a portion of a plastic material;

maintaining a portion of the plastic material extending from said coil portion flat;

heating the coiled portion and the flat portion of said plastic material to a temperature below the melting temperature of the plastic material; and bending the free end of the flat portion of plastic material to form a product stop.

* * * * *